US006042243A

United States Patent [19]

Grill et al.

[11] Patent Number: 6,042,243

[45] Date of Patent: Mar. 28, 2000

[54] MODULAR LIGHT BOX

[75] Inventors: James L. Grill, Toledo, Ohio; Roger D. Crawford, Lambertville, Mich.; Alfred G. Recknagel, Temperana, Mich.; Nicholas W. Hartzell, Temperance, Mich.; George B. Decker, Toledo, Ohio

[73] Assignee: Exhibit & Display Center, Inc., Toledo, Ohio

[21] Appl. No.: 08/928,096

[22] Filed: Sep. 11, 1997

Related U.S. Application Data

[60] Provisional application No. 60/025,891, Sep. 13, 1996.

[51] Int. Cl.[7] ..... G09F 13/08

[52] U.S. Cl. ..... 362/125; 362/221; 362/223; 362/224; 362/812; 40/618; 40/611; 40/605; 40/575

[58] Field of Search ..... 40/367, 558, 572, 40/605, 620, 542, 541, 544, 564, 575, 576, 611, 618, 619; 52/793; 428/80; 362/125, 238, 226, 221–225, 367, 364–366, 812; 160/351; 345/903; 217/131

[56] References Cited

U.S. PATENT DOCUMENTS

| | | | |
|---|---|---|---|
| 3,840,732 | 10/1974 | Cohen | 240/10 |
| 4,380,880 | 4/1983 | Gandy | 40/564 |
| 4,422,443 | 12/1983 | Arendt | 126/418 |
| 4,490,776 | 12/1984 | Kluch | 362/16 |
| 5,080,950 | 1/1992 | Burke | 428/81 |
| 5,276,598 | 1/1994 | Hedenström et al. | 362/238 |
| 5,379,540 | 1/1995 | Howard | 40/558 |
| 5,379,551 | 1/1995 | Swapp | 49/82.1 |
| 5,526,622 | 6/1996 | Augustine | 52/309.9 |

*Primary Examiner*—Sandra O'Shea
*Assistant Examiner*—Ismael Negron
*Attorney, Agent, or Firm*—Marshall & Melhorn

[57] ABSTRACT

A modular light box comprises a rectangular frame defining an enclosure and a front rectangular opening. The frame is formed of a pair of side panels, a bottom panel and a top panel, each of which is provided with a substantially flat, rectangular outer surface and an electrical wiring port extending from within the enclosure out through an opening in the outer surface of the panel. A translucent display panel bearing one or more decorative or informational images is mounted within the opening defined by the frame. Another such display panel may optionally mounted in the rear opening in the frame. One or more lamps are mounted within the enclosure to provide backlighting for the front, and optionally the rear, display panel. In a preferred embodiment of the invention, one or more of the panels forming the frame of the modular light box is constructed with a rectangular core of foamed plastic having a rigid support frame about its periphery and a plastic layer adhered to each of the major surfaces thereof.

14 Claims, 5 Drawing Sheets

MODULAR LIGHT BOX

RELATED APPLICATION

This application is claiming the benefit, under 35 USC §119(e), of the provisional application filed Sep. 13, 1996 under 35 USC § 111 (b), which was granted a Ser. No. of 60/025,891. The provisional application, Ser. No. 60/025, 891, is hereby incorporated by reference.

BACKGROUND OF THE INVENTION

1. Field of the Invention

This invention relates generally to lighted displays. More particularly, the invention relates to a modular light box which may be used alone or in combination with additional modular light boxes to form a lighted display. The modular light boxes of the invention may be especially advantageously used to create lighted promotional displays, such as those often used at trade shows and the like.

2. Summary of Related Art

It is generally considered that the best presentation of an image or informational display for trade show exhibits and the like is by backlighting a translucent image. Traditional light boxes, however, are rigid massive structures generally custom made of wood, metal and plastic. These backlit displays utilize images formed on plastic sheeting or the like secured to the front members of a wood or metal space frame. The backlighting is provided by several fluorescent lamp units suspended on the opaque, rear side of the space frame. Considerable effort has been required to design and construct such light boxes for new applications requiring varying sizes and shapes. Each of these light boxes, being custom made, is relatively expensive. Moreover, the conventional light box is relatively heavy, increasing the costs and difficulties associated with the shipping, assembly and disassembly of the exhibits formed therewith.

SUMMARY OF THE INVENTION

The invention is directed to a modular light box comprising a rectangular frame defining an enclosure and a front rectangular opening. The frame may optionally also define a rear rectangular opening which is substantially parallel to and spaced apart from the front opening. The frame is formed of a pair of side panels, a bottom panel and a top panel, each of which is provided with a substantially flat, rectangular outer surface. At lease three and preferably all four of these panels are provided with an electrical wiring port extending through an opening in the outer surface of the panel, thereby providing communication from the interior to the exterior of the enclosure.

A transparent or translucent rectangular display panel bearing one or more decorative or informational images is mounted within the rectangular opening defined by the frame. Another such display panel may optionally mounted in the rear opening in the frame. Each of the display panels is preferably easily removable and replaceable. One or more lamps are mounted within the enclosure to provide backlighting for the front, and optionally the rear, display panel. The lamps are electrically connected by means of conventional power cords housed within the enclosure, with the ends of the power cords being adapted to extend from the interior to the exterior of the light box through selected wiring ports.

In a preferred embodiment of the invention, one or more of the panels forming the frame of the modular light box is constructed with a rectangular core of foamed plastic having a plastic layer adhered to each of the major surfaces thereof. In a most preferred embodiment, a panel support frame is provided about the entire periphery of the foamed plastic core, with a plastic layer adhered to substantially all of both of the opposed major surfaces defined by the combination of the foamed plastic core and the panel support frame. The support frame is formed of a strong, rigid material such as wood or metal. A wood panel support frame is preferred.

The invention provides an improved light box which is free-standing, self-supporting and modular in construction, so that two or more of the light boxes can be joined together to easily create decorative and/or informational displays of varying size and shape. The improved modular light box of the invention is also readily adapted to provide a modular light box having a backlit decorative and/or informational display on both the front and rear surfaces thereof. Further, the light box of the invention is of relatively lightweight construction, resulting in reduced shipping costs and increased ease of assembly and disassembly of the display formed therewith.

BRIEF DESCRIPTION OF THE DRAWINGS

The advantages of the invention will become readily apparent to those skilled in the art from the following detailed description of a preferred embodiment when considered in the light of the accompanying drawings in which.

DETAILED DESCRIPTION OF THE INVENTION

Figure 1:
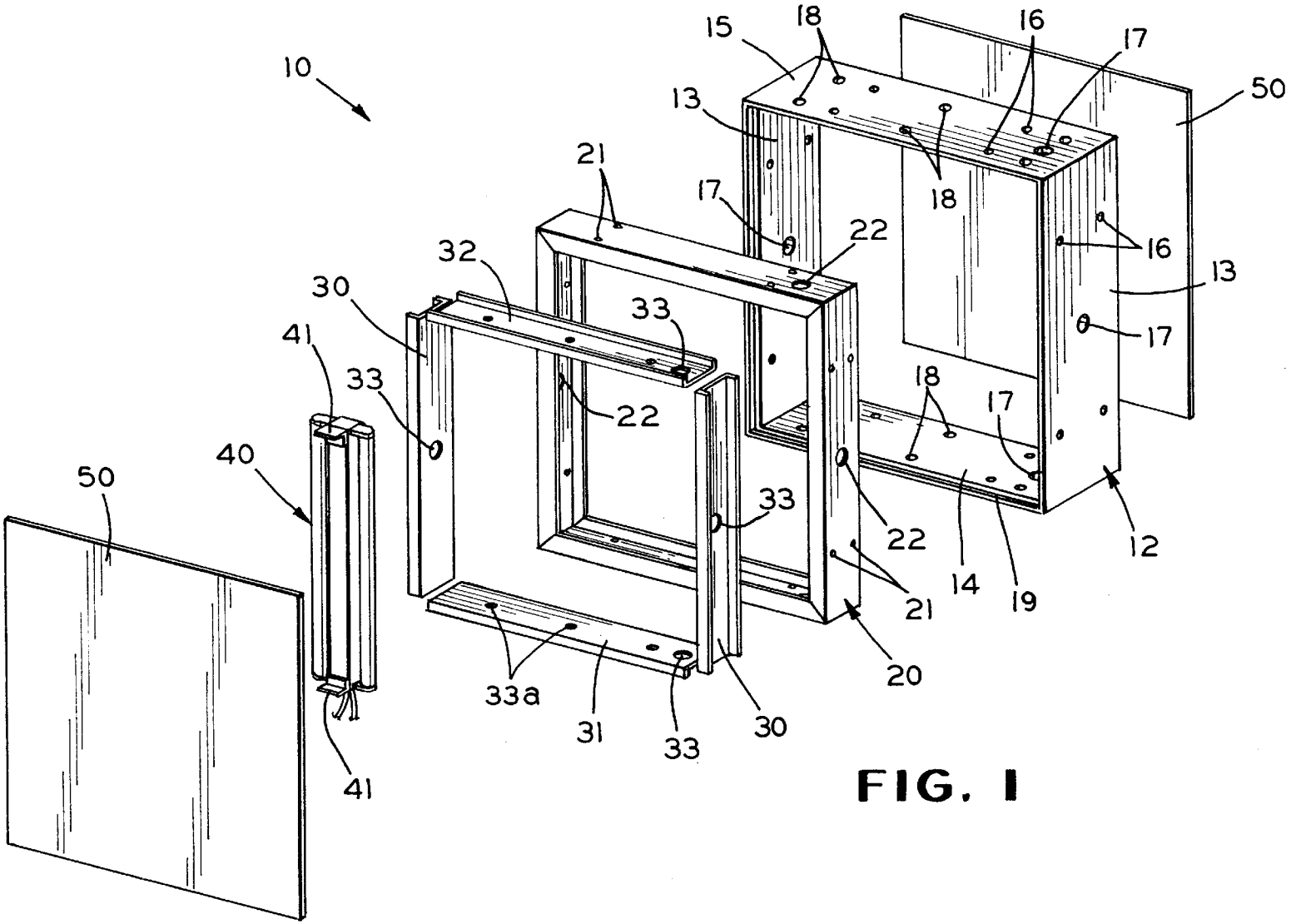
FIG. 1 is an exploded perspective view of a modular light box in accordance with the invention.
Figure 7:
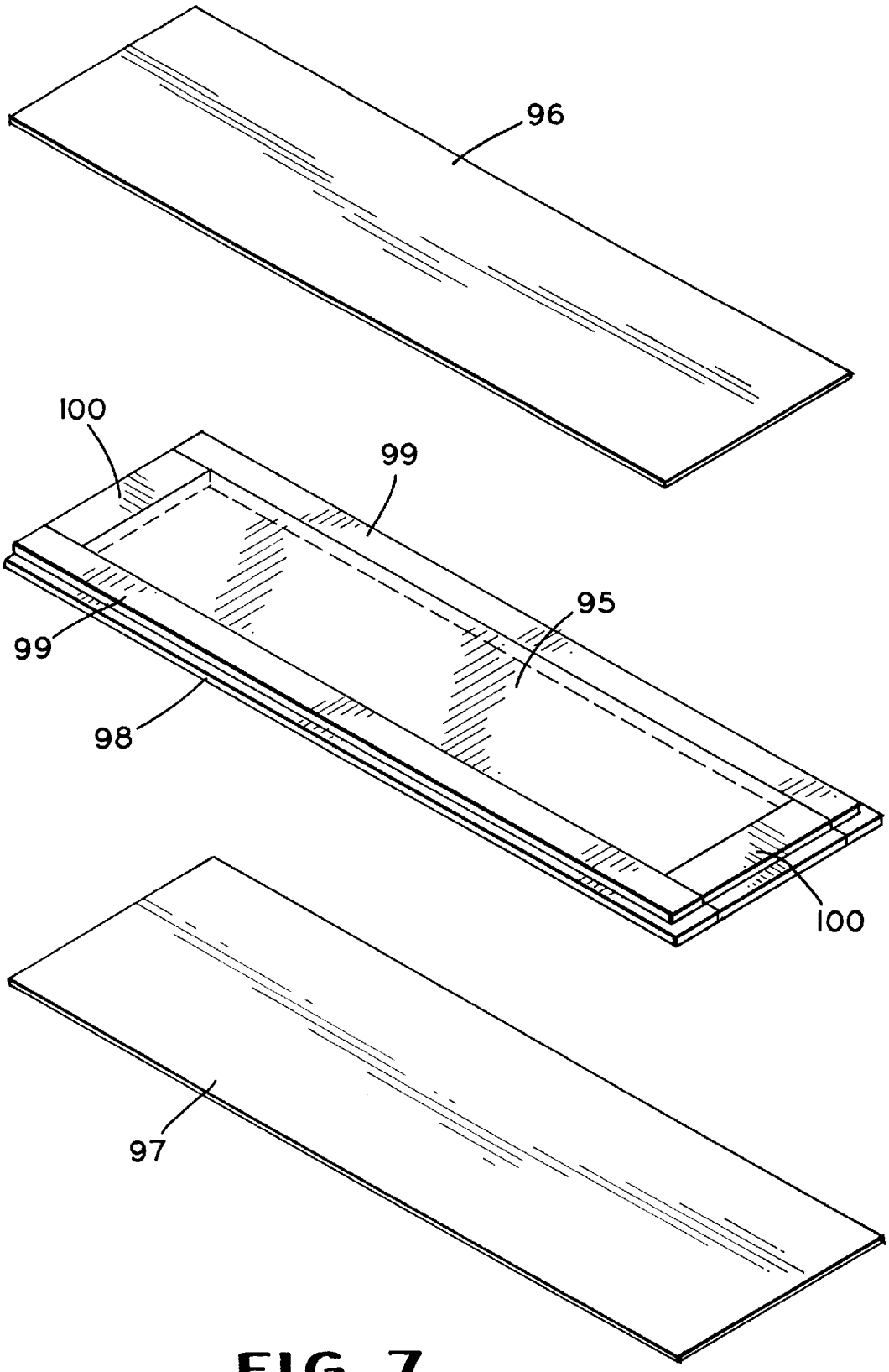
FIG. 7 is an exploded perspective view of a single panel, prior to the formation of any openings, used in the embodiment of the invention illustrated in FIGS. 5 and 6.

Referring now to the drawings, one embodiment of the modular light box of the invention, indicated generally at 10, is illustrated in the exploded perspective view of FIG. 1. The light box 10 is comprised of a rectangular, preferably square, frame 12. The frame 12 is typically on the order of 3 feet by 3 feet, but the dimensions are not critical and may vary widely depending upon the particular application. The frame 12 may be formed of any material which is rigid and of sufficient strength to support the remaining components of the light box, as well as any additional display elements, such as other modular light boxes. Plywood is one preferred material for forming the frame 12. A most preferred construction for the frame is illustrated in FIG. 7 and discussed in detail below.

The frame 12 of the light box 10 includes a pair of side panels 13, a bottom panel 14 and a top panel 15. The four panels may be joined in any conventional manner, such as by fasteners or adhesives, to form the frame 12. Each of the panels 13, 14 and 15 is provided with a plurality of attachment through holes 16 for receiving attachment means, such as nut and bolt assemblies, for securing adjacent light boxes together. Preferably, the attachment holes 16 are located in identical positions on each of the panels 13, 14 and 15, to provide the greatest degree of flexibility in securing the modular light boxes of the invention together. The number and positioning of the attachment holes 16 will depend upon the weight and size of the modular light boxes.

Figure 2:
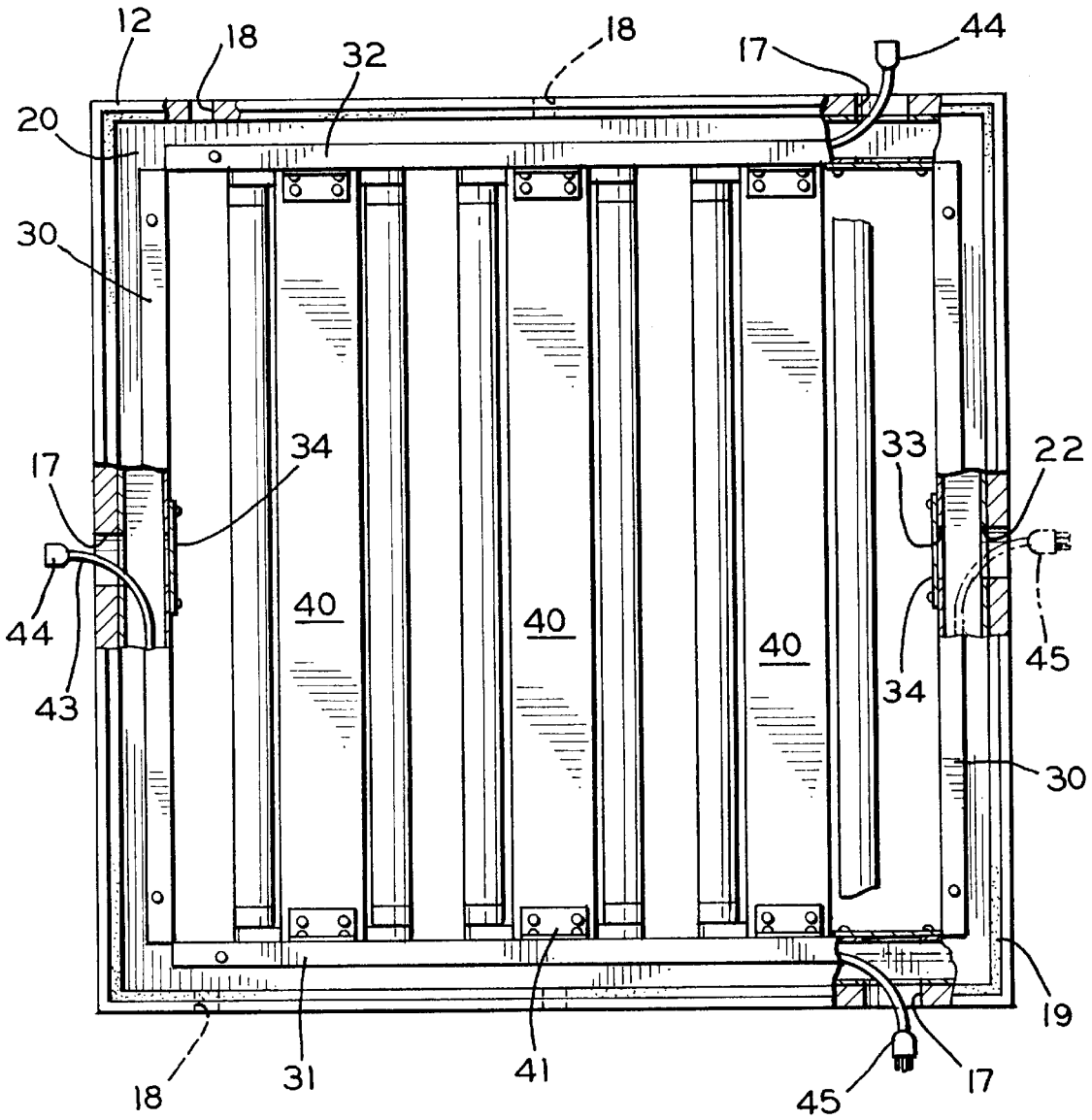
FIG. 2 is a plan view, with portions broken away, of the modular light box of the invention.

Each of the panels 13, 14 and 15 is also preferably provided with an electrical wiring port 17. The ports 17 provide access for any electrical lines which must pass between the interior and the exterior of the light box 10. In the embodiment illustrated in the drawings, the ports 17 are located at about the center of the side panels 13, and near the right end (as shown in FIGS. 1 and 2) of the bottom and top panels, 14 and 15 respectively. The ports 17 are preferably located in identical positions where multiple light boxes are employed, so that the respective ports 17 in adjacent light boxes 10 are aligned, providing a passage between the interiors of the respective light boxes 10.

In a preferred embodiment, one or more of the panels is also provided with a plurality of ventilation holes 18. In the illustrated embodiment, a plurality of ventilation holes are provided in the bottom and top panels 14 and 15. The number of ventilation holes 18 required depends primarily on the number and the power of the lighting units used within the light box 10.

Both of the peripheral edges of the frame 12 are rabbeted, so that the frame 12 is adapted to receive the peripheral edge of a decorative display panel, as described in more detail below. A strip 19 of hook and loop type closure material (commercially available, for example, under the trademark VELCRO™), best seen in FIG. 2, is preferably secured within the rabbeted edge of the frame 12 about its entire periphery to retain the decorative panel in position.

A raceway 20, adapted to house the various electrical wires for the light box 10, is mounted within the frame 12. The raceway 20 is formed of a size and shape so that the sides of the raceway 20 abut each of the panels 13, 14 and 15 of the frame 12. The raceway 20 is secured to the frame 12 in any conventional manner, such as by the use of a plurality of threaded fasteners received in fastening holes 21 formed in the raceway 20. In the embodiment shown in FIG. 1, each side of the raceway 20 is provided with four fastening holes 21.

Figure 4:
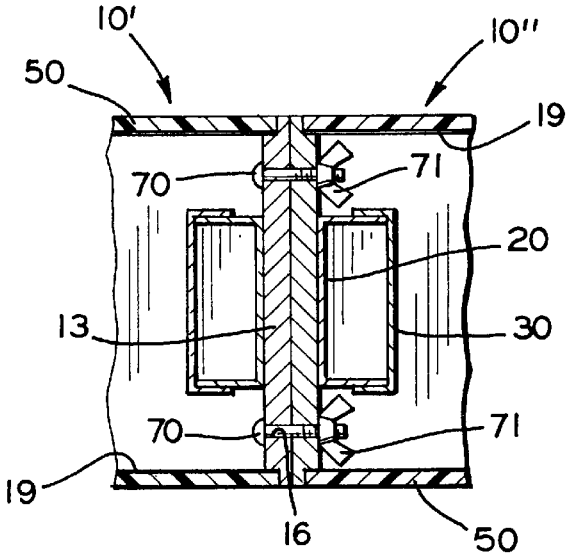
FIG. 4 is an enlarged sectional view taken along the line 4—4 of FIG. 3.

While the raceway 20 may be formed of separate sections, each corresponding to one of the panels of the frame 12, the raceway 20 may be formed as a one-piece unit to provide additional dimensional stability for the light box 10. Each side of the raceway 20 is provided with an electrical wiring port 22 which is positioned so as to be aligned with the corresponding port 17 in the frame 12. As best illustrated in FIG. 4, the raceway 20 is formed with a generally U-shaped cross section. The raceway 20 is preferably formed of aluminum.

The modular light box 10 is also provided with two side raceway covers 30, a bottom raceway cover 31, and a top raceway cover 32. The raceway covers 30, 31 and 32, which are preferably formed of a generally U-shaped cross section, are each secured to a corresponding side of the raceway 20. The covers 30, 31 and 32 and the raceway 20 together form an enclosed passageway for the electrical wiring of the light box 10, as best illustrated in FIGS. 2 and 4.

The side covers 30, bottom cover 31 and top cover 32 are each provided with an access port 33 which is positioned so as to be in general alignment with the corresponding port 17 in the frame 12, as well as the corresponding port 22 in the raceway 20. Each of the access ports 33 is provided with a removable cover plate, as illustrated at 34 in FIG. 2. One or more of the covers 30, 31 and 32 is also provided with one or more wiring ports 33*a*, depending upon the desired positioning of lighting units within the light box 10. In the illustrated embodiment, the bottom and top covers 31 and 32 are each provided with three wiring ports 33*a*. The covers 30, 31 and 32 may also be provided with a plurality of fastening holes 35 for receiving fastening means, such as threaded fasteners, for securing the various raceway covers to the raceway 20. The covers 30, 31 and 32 are all preferably formed of metal, such as steel or aluminum.

One or more lighting units or lamps 40 are disposed within the light box 10 and mounted to one or more of the covers 30, 31 and 32. The type of lighting unit 40 employed is not critical, although fluorescent lighting fixtures are preferred. Thus, the lighting units 40 themselves are conventional in construction and are shown somewhat schematically in the drawings. The lighting units 40 are secured, in the illustrated embodiment, to the bottom and top covers 31 and 32 by means of a pair of L-shaped brackets 41 and suitable fasteners 42.

The lighting units 40 are electrically connected by means of common power cords 43 which are housed within the enclosed raceway formed by the combination of the raceway 20 and raceway covers 30, 31 and 32. The ends of the power cords 43 may extend from the interior to the exterior of the light box 10 through the aligned ports 22 and 17, formed respectively in the raceway 20 and the frame 12. In the illustrated embodiment as shown in FIG. 2, power cords 43 terminating in female connectors 44 are provided at the ports on the left side and the top of the light box 10, while a power cord 43 terminating in a male electrical connector or plug 45 is provided which may be extended from the port on the right side or the port at the bottom of the light box 10.

A non-decorative background panel (not shown) may be mounted to cover the rear face of the light box 10, with a removable decorative display panel 50 mounted in the rabbeted front face of the light box 10. Optionally, removable decorative display panels 50 may be mounted in both of the rabbeted faces of the light box 10.

Generally, when using the invention as a light box, the decorative display panels 50 are formed of a sheet of a translucent or transparent material, such plastic or glass. The display panels 50 are formed of a shape and size so as to fit relatively closely within the rabbeted face of the frame 12 of the light box 10. The display panels 50 may be secured to the frame 12 by any suitable means. Preferably, the major surface of the display panel 50 facing the interior of the light box 10 is provided with strip (not shown) of hook and loop type closure material about its periphery. This strip on the panel 50 is adapted to engage the complementary hook and loop type closure strip 19 secured in the rabbeted edge of the frame 12. As a result, the display panels 50 may be temporarily secured to and easily removed from the frame 12 of the light box 10.

The display panels 50 are often provided with one or more decorative and/or informational images, designs or patterns (not shown) on one or both of the major surfaces thereof. Such images, designs or patterns may be applied to the panel 50 using any of the conventional techniques.

Figure 3:
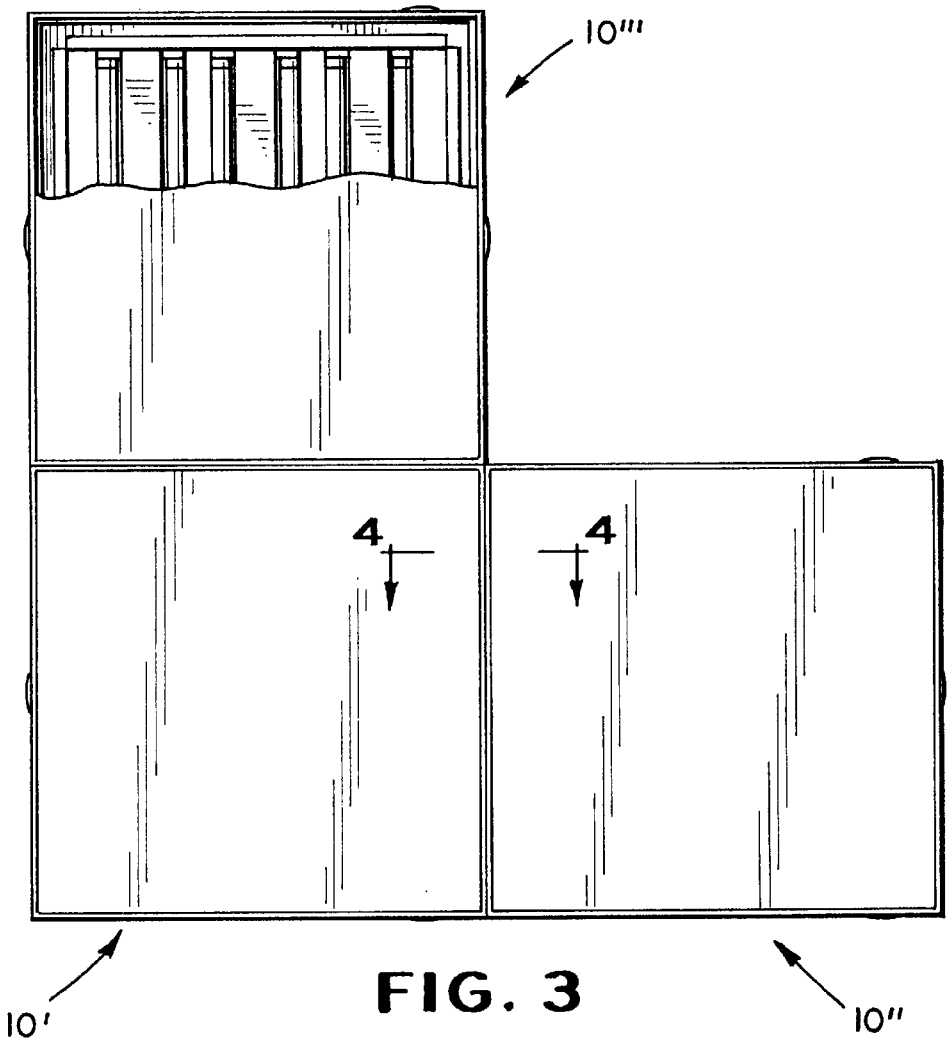
FIG. 3 is a schematic view of three of the modular light boxes of the invention joined together.

To create decorative and/or informational displays of varying size and shape, a plurality of the modular light boxes of the invention may be joined together, as illustrated in FIGS. 3 and 4. In the display as shown in FIG. 3, a first light box 10' is secured to a second light box 10" in a side-by-side relationship. A third light box 10'" is secured on top of and to the first light box 10'. As will be appreciated by those skilled in the art, the images, patterns or designs on the respective decorative display panels 50 mounted in the light boxes 10', 10" and 10'" may be completely separate from one another, may be complementary to one another, or may combine to form a single image, pattern or design.

FIG. 4 illustrates one arrangement, preferred for its simplicity, ease of use, and low cost, for securing one light box 10' to an adjacent light box 10". Bolts 70 are received in the attachment holes 16 formed in the respective side panels 13. Wing nuts 71 are then assembled on the threaded ends of the bolts 70 to securely attach the two light boxes together with their respective side panels 13 in abutting relationship.

Figure 5:
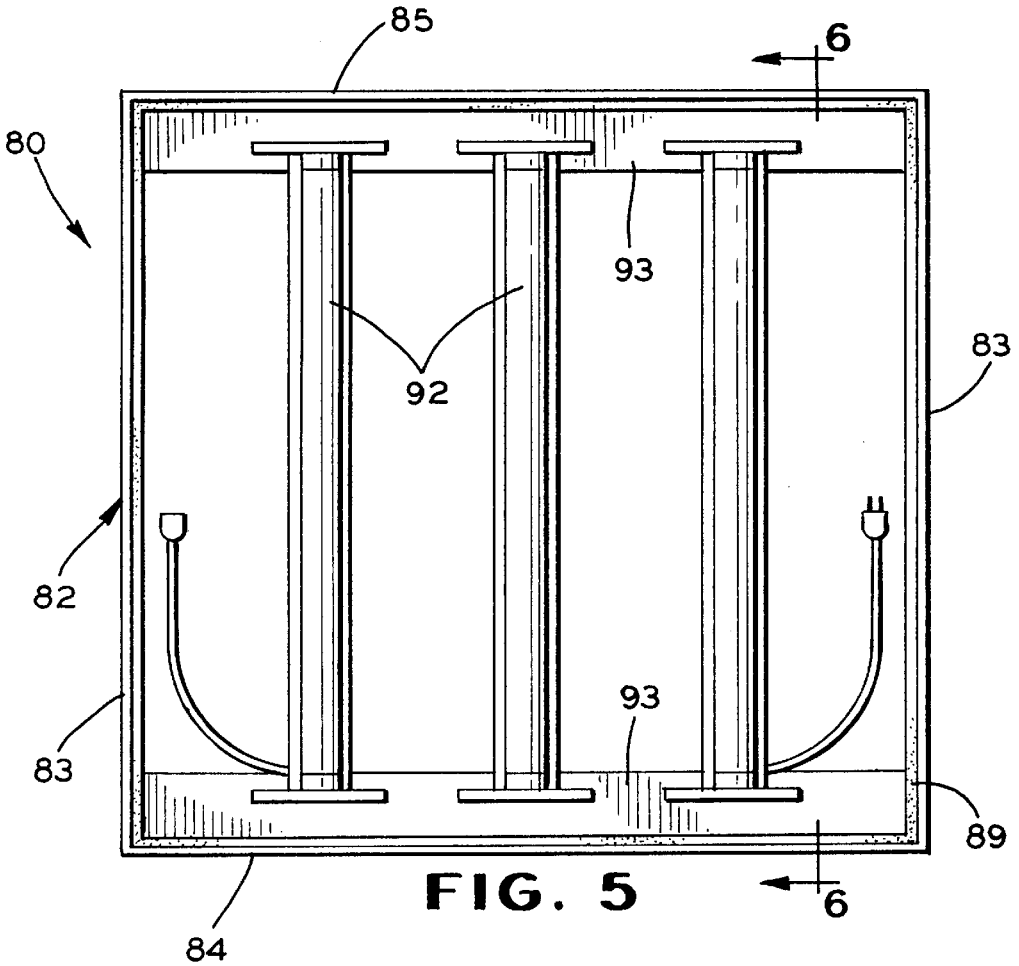
FIG. 5 is a plan view of an alternate embodiment of a modular light box in accordance with the invention.
Figure 6:
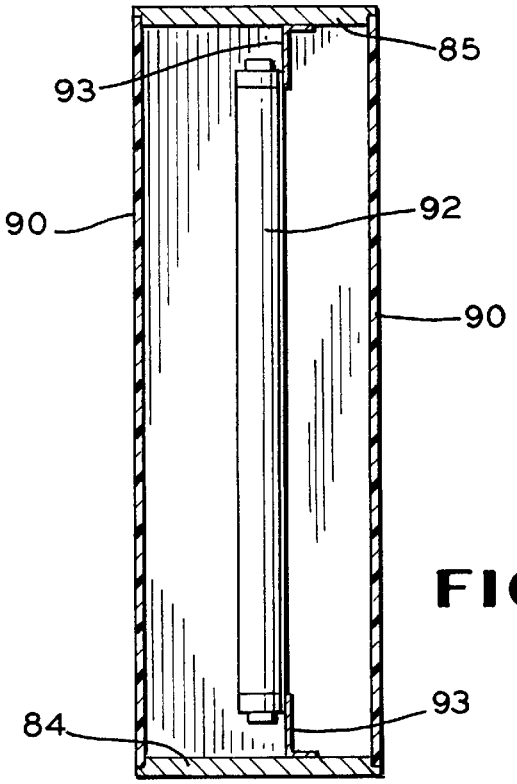
FIG. 6 is a sectional view taken along the line 6—6 of FIG. 5.

FIGS. 5–7 illustrate an alternate embodiment of the modular light box of the invention, indicated generally at 80. The light box 80 is again comprised of a rectangular, preferably square, frame 82. The frame 82 includes a pair of side panels 83, a bottom panel 84 and a top panel 85. The four panels may be joined in any conventional manner, such as by mechanical fasteners or adhesives, to form the frame 82. As in the embodiment discussed above, each of the panels 83, 84 and 85 is provided with a plurality of attachment through holes (not shown) for receiving attachment means, such as nut and bolt assemblies, for securing adjacent light boxes together. Preferably, the attachment holes are located in identical positions on each of the panels to provide the greatest degree of flexibility in securing the modular light boxes of the invention together. Thus, a plurality of the modular light boxes 80 may be joined together to create decorative and/or informational displays of varying size and shape in the same manner as that discussed for the embodiment of FIGS. 1–4.

Each of the panels 83, 84 and 85 is also preferably provided with an electrical wiring port (not shown) in a manner similar to that discussed above. Such ports provide access for any electrical lines which must pass between the interior and the exterior of the light box 80, and are preferably located in identical positions where multiple light boxes are employed, so that the respective ports in adjacent light boxes are aligned, providing a passage between the respective interiors thereof. In a preferred embodiment, one or more of the panels is also provided with a plurality of ventilation holes (not shown).

Both of the peripheral edges of the frame 82 are rabbeted so that the frame 82 is adapted to receive the peripheral edge of a decorative display panel in the manner discussed above. Thus, a strip of hook and loop type closure material 89 is preferably secured within the rabbeted edge of the frame 82 about its entire periphery to retain a decorative panel 90 in position. The decorative display panels 90 are as discussed above with regard to the embodiment of FIGS. 1–4.

One or more lighting units or lamps 92 are disposed within the light box 80. The lighting units 92 are mounted to the interior surfaces of either the two opposed side panels 83 or, alternatively, the bottom and top panels 84 and 85. The type of lighting unit 92 employed is not critical, although fluorescent lighting fixtures are preferred. The lighting units 92 themselves are conventional in construction and are shown schematically in the drawings. The lighting units 92 are secured, in the embodiment illustrated in FIGS. 5 and 6, to the bottom and top panels 84 and 85 by means of a pair of elongate, L-shaped brackets 93 and suitable fasteners (not shown). The lighting units 92 are electrically connected by means of common power cords 94 which are housed within the frame 82 in the same manner as discussed above with regard to the embodiment of FIGS. 1–4. Thus, the ends of the power cord 94 may extend from the interior to the exterior of the light box 80 through the port formed in any of the panels 83–85.

In a most preferred embodiment of the invention, at least one and preferably all of the panels 83–85 are formed of a rectangular core 95 of foamed plastic and defining a pair of opposed major surfaces. As best seen in the exploded perspective view of FIG. 7, an inner plastic layer 96 is adhered to one of the major surfaces of the core 95, and an outer plastic layer 97 is adhered to the other major surface. The plastic layers 96, 97 may be formed of any suitably strong polymeric material, and may be formed of the same or different materials. Vinyl chloride polymer sheets, such as that commercially available under the trademark Sintra from Lonza AG (Alusuisse), are preferred materials for the plastic layers 96, 97. In another preferred embodiment, the plastic layers 96, 97 are formed of a high pressure decorative laminate, such as that commercially available under the trademark Formica from Formica Corporation.

A panel support frame 98 is also preferably provided about the periphery of the foamed plastic core 95, lending strength and dimensional stability to the panel. The panel support frame 98 is comprised of a pair of side members 99 secured at their respective ends to a pair of end members 100, each formed of a suitably strong, rigid material such as wood or metal. As shown in FIG. 7, the outer edges of the side members 99 are provided with a rabbet so that the resulting frame is adapted to receive the display panel 90 as discussed above. The outer edge of one of the end members 100 may likewise be provided with a rabbet (as with the end member 100 to the right in FIG. 7) to receive the end of an adjacent, perpendicularly oriented panel (not shown) to form the rectangular frame. The end members 100 are preferably of sufficient width to receive the fasteners used to secure the brackets 93 to the frame 82.

The plastic layers 96 and 97 are preferably adhered to substantially all of both of the opposed major surfaces defined by the combination of the foamed plastic core 95 and the panel support frame 98. While not shown in FIG. 7, the wiring ports and ventilation openings are preferably formed so as to extend through the plastic layers 96, 97 and core 95, while any attachment openings are preferably formed so as to extend through the plastic layers 96, 97 and the support frame 98. A modular light box 80 formed with one or more panels 83–85 in accordance with this embodiment of the invention provides especially significant weight savings over conventional light boxes.

The modular light boxes of the invention can therefore act as single or double sided light boxes for holding decorative and/or informational displays of varying size and shape. These light boxes can also be used as dimensional receptacles for flat graphics, product mounts or photographs, in which case the lighting units are not used. In addition, they can be converted into shadow box units simply by removing the display panels and the electrical raceway and lights as a unit, and inserting, for example, a shelving unit.

In accordance with the provisions of the patent statutes, the invention has been described in what is considered to represent its preferred embodiments. However, it should be noted that the invention can be practiced otherwise than as specifically illustrated and described without departing from its spirit or scope.

What is claimed is:

1. A modular light box comprising:

a rectangular frame defining an enclosure and a rectangular opening and a second rectangular opening which is spaced apart from and parallel to said opening, said frame being formed of a pair of side panels, a bottom panel and a top panel, each of said panels having a substantially flat, rectangular outer surface, and wherein at least three of said panels are provided with an electrical wiring port extending through to said outer surface of said panel;

a transparent or translucent rectangular display panel mounted within the rectangular opening defined by said frame and a second transparent or translucent rectangular display panel mounted in said second rectangular opening; and one or more lamps mounted within said enclosure to back light said display panels.

2. A modular light box as defined in claim 1, wherein each of said side panels, said bottom panel and said top panel are provided with an electrical wiring port extending from within said enclosure through said outer surface of said panel to outside said enclosure.

3. A modular light box as defined in claim 1, wherein the openings defined by said frame are rabbeted to receive said display panels.

4. A modular light box as defined in claim 3, wherein complementary hook and loop type closure means are provided about the periphery of said display panels and about the rabbeted openings defined by said frame.

5. A modular light box as defined in claim 1, further comprising means extending through one of said side, bottom or top panels forming said frame for securing said modular light box to another, adjacent light box in an abutting relationship.

6. A modular light box as defined in claim 1, wherein said display panel includes a decorative or informational image.

7. A modular light box as defined in claim 1, wherein said second display panel includes a decorative or informational image.

8. A modular light box as defined in claim 1, wherein at least one of said side, bottom or top panels forming said frame comprises a foamed plastic core having a pair of opposed major surfaces with a plastic layer adhered to each of said major surfaces.

9. A modular light box comprising:

a rectangular frame defining an enclosure and a rectangular opening, said frame being formed of a pair of side panels, a bottom panel and a top panel, at least one of said panels comprises a foamed plastic core having a pair of opposed major surfaces and a plastic layer adhered to each of said major surfaces;

a transparent or translucent rectangular display panel mounted within the rectangular opening defined by said frame; and one or more lamps mounted within said enclosure to back light said display panel.

10. A modular light box as defined in claim 9, wherein each of said panels is comprised of a foamed plastic core having a pair of opposed major surfaces and a plastic film adhered to each of said major surfaces.

11. A modular light box as defined in claim 9, wherein said at least one panel further comprises a rigid panel support frame extending about the periphery of said core, with a plurality of plastic layers being adhered to said core and said support frame.

12. A modular light box assembly comprising at least two modular light boxes secured together in abutting relationship, each of said modular light boxes comprising:

(a) an open rectangular frame defining an enclosure and a rectangular opening, said frame being formed of a pair of side panels, a bottom panel and a top panel, each of said panels having a substantially flat, rectangular outer surface, and wherein at least three of said panels are provided with an electrical wiring port extending from within said enclosure through said outer surface of said panel;

a transparent or translucent rectangular display panel mounted within the rectangular opening defined by said frame; and one or more lamps mounted within said enclosure to back light said display panel.

13. A modular light box assembly as defined in claim 12, wherein a bottom panel of a first light box is secured to a top panel of a second light box.

14. A modular light box assembly as defined in claim 12, wherein a side panel of said first light box is secured to a side panel of said second light box, and a bottom panel of a third light box is secured to a top panel of said first light box.

* * * * *